United States Patent [19]

Hartwell

[11] Patent Number: 4,954,384

[45] Date of Patent: Sep. 4, 1990

[54] FOOD RACK COVER

[76] Inventor: Carol Hartwell, 16877 Orchard Ridge, Hazel Crest, Ill. 60429

[21] Appl. No.: 463,921

[22] Filed: Jan. 10, 1990

Related U.S. Application Data

[63] Continuation of Ser. No. 290,030, Dec. 27, 1988, abandoned.

[51] Int. Cl.[5] ..... B32B 3/06; B65D 65/26

[52] U.S. Cl. ..... 428/100; 52/3; 150/154; 150/165

[58] Field of Search ..... 428/100; 150/158, 154, 150/165; 52/3

[56] References Cited

U.S. PATENT DOCUMENTS

| | | | |
|---|---|---|---|
| 2,899,340 | 8/1959 | Cohen et al. | 428/907 |
| 3,185,197 | 5/1965 | Spiro et al. | 428/100 |
| 4,174,418 | 11/1979 | Welch et al. | 428/907 |
| 4,244,411 | 1/1981 | Karlstrom et al. | 150/154 |
| 4,811,767 | 3/1989 | Kessler | 150/154 |

*Primary Examiner*—Alexander S. Thomas

*Attorney, Agent, or Firm*—Neuman, Williams, Anderson & Olson

[57] ABSTRACT

A cover for racks holding food items made of canvas cloth in the form of an open bottom hood. The cover is divided at one or more locations to form two mating edge portions which can be separated to permit access to the interior of the cover. The cover includes non-metallic fastening means for joining the separable edge portions to form a closed hood.

7 Claims, 2 Drawing Sheets

FOOD RACK COVER

This application is a continuation of application Ser. No. 290,030 filed Dec. 27, 1988 abandoned.

This invention relates to a protective cover for racks on which food items are held.

There are many applications wherein it is desirable to provide a cover medium for protecting items from contamination or from the environment, and particularly food items.

Thus, in commercial bakeries it is common practice to hold trays of bakery goods, either prior to or after baking, in racks. Frequently frozen food products are stored in racks under refrigeration. Often racks of bakery goods are, after baking, maintained for some time before shipment. Also, unused bakery goods are stored on racks overnight for use the following day. Quite commonly, the racks on which bakery goods are placed are covered with plastic covers which are closed by means of zippers. Such plastic covers as have heretofore been used have a number of disadvantages, e.g., the plastic is highly susceptible to fracture or tearing, the plastic is affected by temperature and at low temperatures may crack, and the metal zippers used on such plastic covers tend to rust, which itself presents further contamination problems.

It is a principal object of this invention to provide a novel and advantageous cover which can be used to cover racks holding food items.

It is another object of the invention to provide a cover for racks which hold food items which cover is flexible, water-resistant and highly resistant to tearing and cracking so as to provide long usage.

It is a specific object of the invention to provide a cover which is particularly adapted to cover racks containing bakery goods.

This invention provides a cover for racks holding food items, such as baked or unbaked food items. The cover is canvas cloth in the form of an open bottom hood and is divided at one or more locations to form two mating and over-lapping edge portions which can be separated to permit access to the interior of the cover. The cover is provided with non-metallic fastening means for joining the separable edge portions to form a closed hood.

The characterizing features of the present invention will be described with reference to the accompanying drawings in which.

Figure 1:
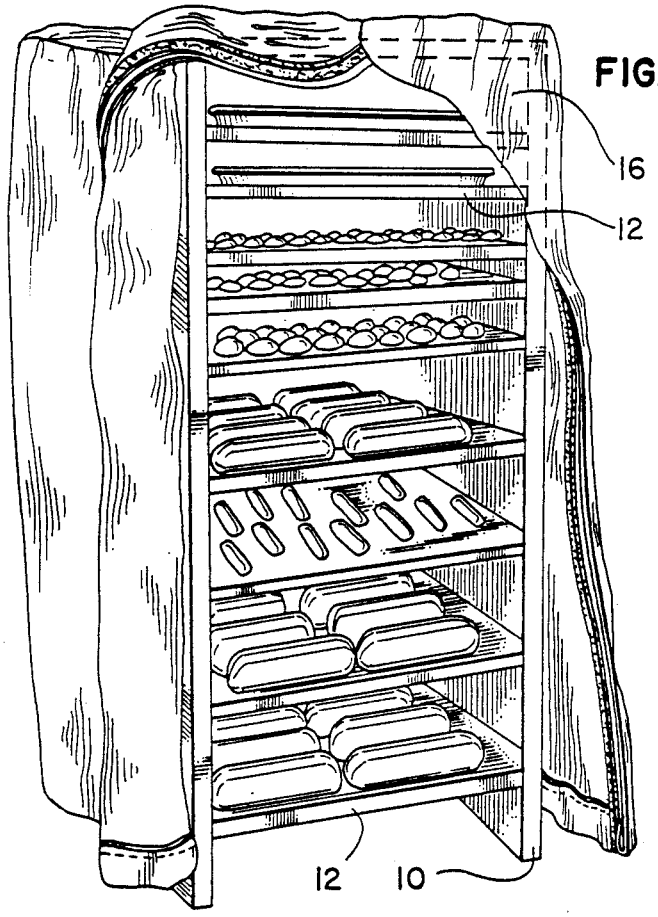
FIG. 1 illustrates a cover constructed in accordance with this invention as it would be used with a free-standing single rack holding a plurality of trays of bakery goods.

With reference to FIG. 1, a free-standing, relatively large rack 10 is adapted to hold a plurality of trays 12 of bakery goods. The trays 12 are placed lengthwise in the rack from the front thereof and are stacked vertically. To cover the rack and to protect the bakery goods, a cover 16 in accordance with the invention is draped over the rack. The cover is made of canvas cloth woven from linen, hemp or cotton as is known and can be of any suitable weight and coarseness. The cover 16 is divided in a vertical direction in the front thereof as shown to form front sections 18 and 20 having separable mating and overlapping edge portions 18*a* and 20*a*, respectively. Extending along and adjacent to each of the edge portions 18*a* and 20*a* are fastening or closing means which, as illustrated, are strips of Velcro (hook and loop fasteners) 22 and 24 which, as known, are synthetic materials which adhere when pressed together. The Velcro strip 22 is placed on the exterior side of front section 18 while Velcro strip 24 is placed on the interior side of front section 20 so as to be mutually engageable in sealing manner as is well known. Other suitable non-metallic fastening means, such as buttons, cloth hook fastening means and so forth can be used.

The cover of the invention illustrated in FIG. 1 of the drawings is shown to be generally rectangular in form having a rear wall 27, two seamless side walls 29 and 30 and a top 33, as well as the two front sections 18 and 20. The covers of the invention can take various shapes, such as, for example, triangular or circular, depending upon the configuration of the container or rack on which they are to be used. Similarly, the size of the covers can be varied widely as is necessary.

Figure 4:
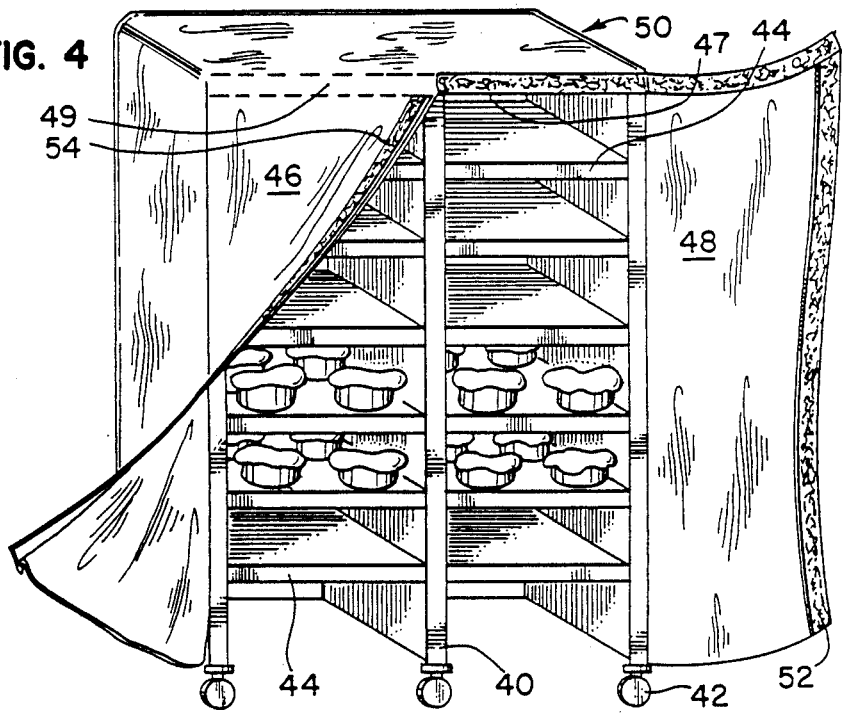
FIG. 4 is a perspective view of another embodiment of the invention showing the cover of the invention as used with a double rack.

Thus, FIG. 4 shows a double rack 40 equipped with rollers 42 adapted to receive a plurality of stacked trays 44. In this embodiment, the cover 50 is divided vertically to form front sections 46 and 48. For ease of access and to provide a wider opening, the cover is also divided horizontally along the tops 47 and 49 of the front sections 46 and 48. Velcro strip 52 extends along and adjacent to the top edge 47 and the vertical edge of front section 48. Similarly, complementary Velcro strip 54 extends along and adjacent to top edge 49 and the vertical edge of front section 46.

Figure 5:
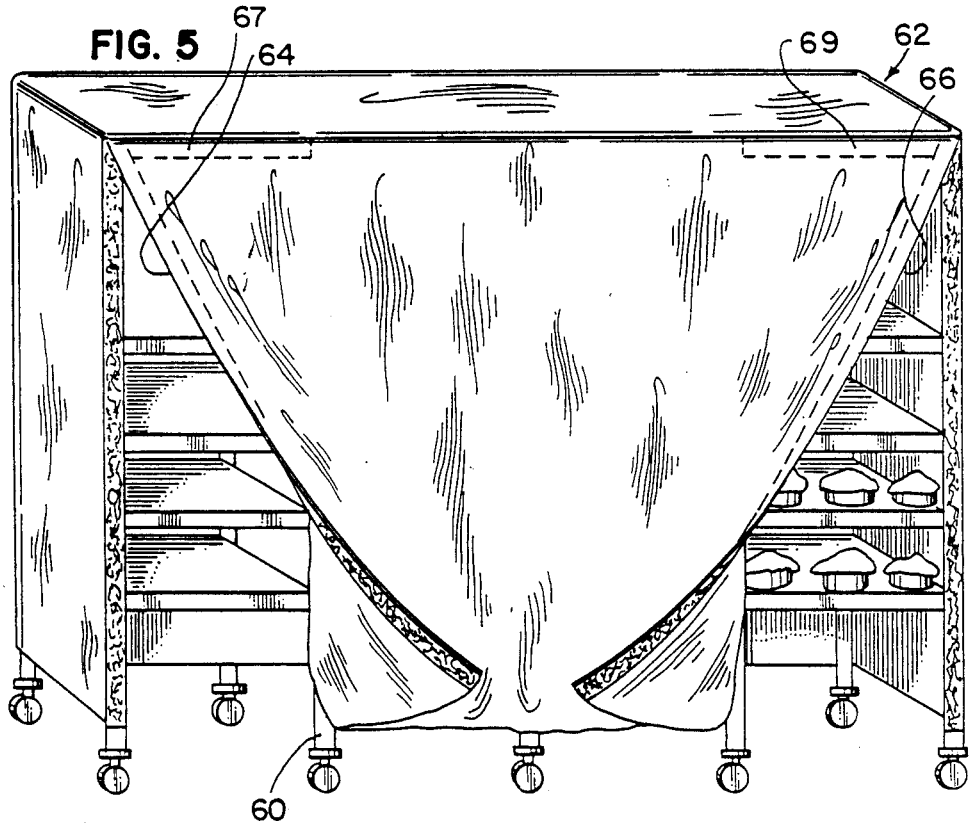
FIG. 5 is a perspective view of another embodiment of the cover of the invention.

FIG. 5 shows a further embodiment of the invention wherein a wide rack 60 or an assembly of racks are arranged in side-by-side relationship. In this embodiment, to provide access at either end of the rack 60, the cover 62 is divided along the juncture of the front and side walls at 64 and 66 and at the top portions 67 and 69. Complementary Velcro or like fastening elements are provided along the edge portions 64, 66, 67 and 69 so as to provide access to the rack assembly 60 at either end.

Figure 2:
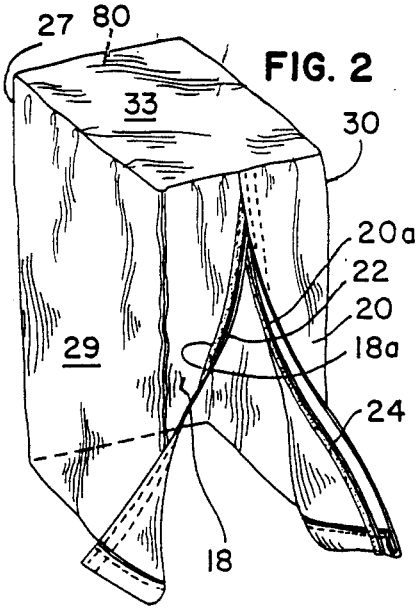
FIG. 2 is a perspective view of one preferred embodiment of a partially open cover of this invention for use with a free-standing single rack.
Figure 3:
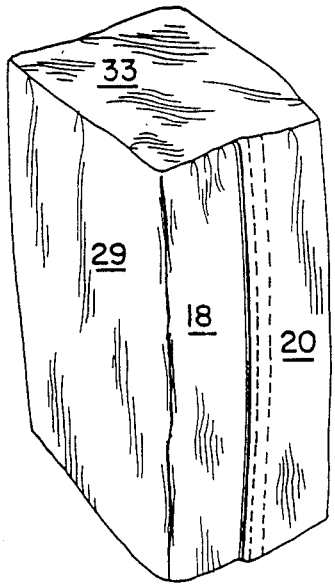
FIG. 3 is a perspective view of the sealed cover of FIG. 2.

The cover of this invention can be constructed also as shown in FIG. 2 by the dotted line 80. In this embodiment, the cover is divided in the rear wall and has fastening means similar to that as described previously with respect to the front of the cover. This permits trays to be inserted or removed from both the front and back of a rack.

From the foregoing description, it is apparent that the covers of this invention possess numerous advantages over plastic covers heretofore used, particularly in commercial bakeries and similar food processing operations. Thus, the new and novel covers, while flexible, are resistant to fluid penetration and resistant to tearing and cracking. The covers "breath" as compared to air-impervious plastic and do not sweat either from ambient temperature conditions or from moisture from the enclosed products The covers are economical also since then can be washed and used repeatedly.

If desired, bactericides, fungicides and anti-mycotics can be applied to the covers and held therein because of their woven nature.

Those modifications and equivalents which fall the spirit of the invention are to be considered a thereof.

What is claimed is:

1. A protective cover for use on a rack adapted for holding one or more trays of food items, the cover being a single layer of air-pervious canvas cloth in the form of an open bottom hood and being divided at one or more locations to form two separable mating edge portions and having non-metallic fastening means joining said separable edge portions, said cover having a configuration conforming substantially to the configuration of the rack on which it is used and being of a size to fit over said rack so as to form an open bottom hood thereover and substantially enclose and protect food items held within said rack.

2. The cover of claim 1 wherein aid non-metallic fastening means for said cover are complementary hook and loop fastening strips.

3. A protective cover for use on a rack adapted for holding one or more trays of food items, the cover being a single layer of air-pervious canvas cloth in the form of an open bottom hood and being divided at one or more locations to form two separable mating edge portions and having non-metallic fastening means joining said separable edge portions, said cover having a configuration conforming substantially to the configuration of the rack on which it is used and being of a size to fit over said rack so as to form an open bottom hood thereover and substantially enclose and protect food items held within said rack, said cover having applied thereto an agent to retard microbiological deterioration of food items held within said rack selected from the group consisting of bactericides, fungicides and antimycotics.

4. A protective cover for use on a rack adapted for holding one or more trays of food items, the cover being a single layer of air-pervious canvas cloth in the form of an open bottom hood, said cover having a front and rear section, each of which is divided substantially in the center thereof to form two separable mating edge portions and having non-metallic fastening means joining said separable edge portions, said cover having a configuration conforming substantially to the configuration of the rack on which it is used and being of a size to fit over said rack so as to form an open bottom hood thereover and substantially enclose and protect food items held within said rack.

5. A protective cover for use on a rack adapted for holding one or more trays of food items, the cover being a single layer of air-pervious canvas cloth in the form of an open bottom hood, said cover having front and two side sections and being divided along at least one juncture of the front and a side section to form two separable mating edge portions and having non-metallic fastening means joining said separable edge portions, said cover having a configuration conforming substantially to the configuration of the rack on which it is used and being of a size to fit over said rack so as to form an open bottom hood thereover and substantially enclose and protect food items held within said rack.

6. In combination, a rack adapted for holding one or more trays of food items, a cover of a single layer of air-pervious canvas cloth in the form of an open bottom hood fitted over said rack, said cover being divided at one or more locations to form two separable mating edge portions and having non-metallic fastening means joining said separable edge portions, said cover having a configuration conforming substantially to the configuration of said rack and being of a size to fit over said rack so as to form an open bottom hood thereover and substantially enclose and protect food items held within said rack.

7. The combination of claim 6 wherein the rack is adapted for holding one or more trays of bakery food items.

* * * * *